United States Patent [19]

Morse et al.

[11] Patent Number: 4,506,519

[45] Date of Patent: Mar. 26, 1985

[54] HERMETIC COMPRESSOR DISCHARGE LINE THERMAL BLOCK

[75] Inventors: Robert L. Morse, Adrian, Mich.; Russell M. Hagan, Vernon Hills, Ill.

[73] Assignee: Tecumseh Products Company, Tecumseh, Mich.

[21] Appl. No.: 526,108

[22] Filed: Aug. 24, 1983

[51] Int. Cl.[3] ..... F25B 1/00

[52] U.S. Cl. ..... 62/190; 62/509

[58] Field of Search ..... 62/174, 83, 512, 509, 62/205, 206, 192, 193, 468, 469, 470, 473, 84, 190

[56] References Cited

U.S. PATENT DOCUMENTS

| | | | |
|---|---|---|---|
| 1,758,074 | 5/1930 | Davenport | 62/83 |
| 1,822,918 | 9/1931 | Barnes | 62/226 |
| 2,175,913 | 10/1939 | Philipp | 230/29 |
| 2,461,342 | 2/1949 | Obreiter, Jr. | 62/115 |
| 2,749,723 | 6/1956 | Webber | 62/470 |
| 2,775,683 | 12/1956 | Kleist | 219/39 |
| 2,836,965 | 6/1958 | Kleist | 62/509 X |
| 2,979,915 | 4/1961 | Gardner | 62/132 |
| 3,176,911 | 4/1965 | Wallace | 230/202 |
| 3,237,848 | 3/1966 | Pihl et al. | 230/58 |
| 3,324,680 | 6/1967 | Cremer | 62/473 |
| 3,412,574 | 11/1968 | Reiter | 62/471 |
| 3,577,741 | 5/1971 | Shaw | 62/84 |
| 3,763,659 | 10/1973 | Hover | 62/115 |
| 3,766,747 | 10/1973 | Parker | 62/226 |
| 3,898,860 | 8/1975 | Shepherd et al. | 62/155 |
| 4,004,431 | 1/1977 | Hildereth | 62/228 |
| 4,019,337 | 4/1977 | Zearfoss, Jr. | 62/509 X |
| 4,066,869 | 1/1978 | Apaloo et al. | 219/490 |
| 4,178,765 | 12/1979 | Slayton | 62/83 |
| 4,178,771 | 12/1979 | Karll | 62/200 |

*Primary Examiner*—Harry B. Tanner

*Attorney, Agent, or Firm*—Albert L. Jeffers; John F. Hoffman

[57] ABSTRACT

A hermetic compressor discharge line thermal block is hermetically coupled in the discharge line between a condenser and compressor adjacent to the discharge outlet of the compressor. The device is formed to define a well for removably receiving a heating element, and has a hermetically sealed chamber substantially surrounding the heater well and electric heating element. Upon compressor shutdown, liquid refrigerant migrating from the condenser partially fills the chamber, thereby decreasing the temperature of the heating element below a predetermined temperature, thereby causing the heating element to become electrically conductive to supply heat to the chamber to evaporate the liquid refrigerant therein and to prevent further accumulation of liquid. If a positive temperature coefficient heater is used, after thermal stabilization and during compressor operation, the heat generated either by the compressor or by the heating element itself raises the temperature of the element, thereby causing the heating element to become substantially less electrically conductive to reduce the supply of heat to the chamber. The discharge line thermal block device prevents the migration of liquid refrigerant from the condenser to the compressor to thereby prevent slugging during compressor start-up.

21 Claims, 5 Drawing Figures

HERMETIC COMPRESSOR DISCHARGE LINE THERMAL BLOCK

BACKGROUND OF THE INVENTION

This invention pertains to a thermal block device, and more particularly to a thermal block device connected to the discharge line between a hermetic motor compressor and a condenser to prevent the migration of liquid refrigerant from the condenser to the compressor during off-cycles.

During the routine operation of a refrigeration system, the compressor is intermittently shut down by a thermostat. When the compressor is thermostatically shut down, and also when the refrigeration system is deenergized, due to the condenser's location its ambient temperature may rise above the compressor ambient temperature, thereby causing liquid refrigerant to migrate from the condenser through the discharge line and into the compressor. The presence of liquid refrigerant in the compressor high side on start-up can cause liquid slugging, which can rupture the compressor gaskets, damage bearings and the like due to the resulting high pressures. Slugging may also occur during compressor start-up if liquid refrigerant migrates from the evaporator through the suction line to the compressor, and attempts have earlier been made in the art to prevent this.

In some refrigerators there are two evaporators, one for the freezer compartment and a smaller evaporator for the refrigerator compartment. When the compressor is not operating, as between thermostat cycles, there tends to be thermal migration from the warmer refrigerator evaporator to the colder freezer evaporator in the refrigeration line that connects the two. This tends to reduce the temperature of the freezer evaporator and requires the system to cycle on and off more frequently. To prevent this migration, it is known to place a heater, such as a resistance heater, in thermal contact with the line connecting the two evaporators to prevent the thermal migration.

It is also known to place a solid state heater or the like in the sump of the compressor so that it is in thermal contact with the oil and refrigerant therein. This is to prevent the problem of liquid refrigerant migration to the compressor through the suction line from the evaporator. The presence of a thermal heater to raise the temperature of the oil in the sump causes the liquid refrigerant therein to return to a vapor state and recondense either in the accumulator connected to the compressor inlet or in the evaporator.

Further, compressor crankcase heaters have been installed to decrease the temperature difference between the condenser and compressor ambient temperatures, and given a sufficient period of time will reduce liquid migration. However, during the short off-cycles of normal thermostat operation, these crankcase heaters have generally proved to be too slow to satisfactorily eliminate the migration of liquid refrigerant from the condenser to the compressor.

Another attempt to preclude liquid refrigerant migration involves coupling a check valve to the discharge line to prevent the migration during off-cycles. However, the use of check valves has generally been undesirable since they often tend to leak, thereby failing to prevent liquid refrigerant migration and creating additional maintenance problems due to the requirement of having to replace the faulty valve.

Presently, there still exists a need for a device or means for preventing the migration of liquid refrigerant from a condenser having a higher ambient temperature to a condenser having a lower ambient temperature.

SUMMARY OF THE INVENTION

The present invention overcomes the problems and disadvantages associated with the prior art by providing a discharge line thermal block, which is connected to the discharge line of a compressor to collect and evaporate liquid refrigerant migrating from the condenser.

The problem of refrigerant migration in prior compressors is overcome by the present invention by providing a thermal block in the discharge line of the compressor. The thermal block comprises a heating device, such as a resistance heater or solid state heater, which is in thermal contact with the discharge line and operates during shut down of the compressor to raise the temperature of the discharge line at that point. This increase in temperature prevents refrigerant in the hotter condenser from migrating back through the discharge line to the cooler compressor head, which could cause slugging on startup.

In installations where the condenser is at a higher temperature than the compressor, such as in the case of roof mounted air conditioner condensers, liquid refrigerant tends to migrate from the condenser back through the discharge line and collect in the cylinder or cylinders of the compressor. It has been found that by increasing the temperature of the discharge line at some point between the condenser and compressor, this migration of liquid refrigerant can be prevented.

In one embodiment of the invention, the thermal block is provided with an inlet and outlet communicating with a chamber wherein the migrating liquid refrigerant must first substantially completely fill the chamber before it can pass through the inlet and then to the compressor. The heating of the chamber by means of the heating element, whether it be a resistance type heater or a positive temperature coefficient heater, evaporates the liquid refrigerant therein forcing it back up through the discharge line to the condenser, and prevents migration of liquid refrigerant to the compressor.

In the disclosed embodiment of the invention, a positive temperature coefficient heater is utilized so that as the migrating liquid refrigerant draws heat away from the PTC material, its electrical conductivity will decrease thereby causing the heating element to supply a greater amount of heat to the chamber to evaporate the refrigerant. The heating element continues to supply heat, but becomes less conductive due to the higher temperature sensed by it when it is no longer surrounded by liquid refrigerant, thereby reducing the power consumption. The PTC heating element has a further advantage in that during the operation of the compressor, the temperature remains high so that current flow is minimized.

In another form of the invention there is provided a thermal block device for connection to a tube to prevent the return flow of liquid therethrough. The thermal block device comprises a housing having an outer wall and an inner wall forming therebetween a closed chamber, and an inlet connected to the tube and an outlet connected to the tube to permit the tube to communicate with the chamber. The housing chamber is adapted to collect and contain the return flow of liquid therein. The inner wall of the housing forms a well for removably receiving an electrical heating element in thermally conductive abutment against the outer surface of the inner wall. The heating element is responsive to temperature to supply increased heat to the housing when the temperature falls and to decrease the supply of heat when the temperature rises. It is an object of the present invention to provide a discharge line thermal block between a compressor and condenser to prevent the migration of liquid refrigerant from the condenser to the compressor. Alternatively, a resistance-type heater could be utilized and thermostatically controlled to supply the heat at the necessary time, or a completely unregulated heater could be used.

It is an object of the present invention to provide a discharge line thermal block between a compressor and condenser to prevent the migration of liquid refrigerant from the condenser to the compressor.

Another object of the present invention is to provide between a compressor and condenser a discharge line thermal block which is self-regulating in response to temperature changes.

A further object of the present invention is to provide between the compressor and condenser a discharge line thermal block connected to the discharge line externally of the compressor and condenser.

A still further object of the present invention is to provide between the condenser and compressor a discharge line thermal block which can be connected to the discharge line without modifying the compressor or condenser.

Yet a further object of the present invention is to provide between a compressor and condenser a discharge line thermal block which will become effective virtually immediately to prevent migration of liquid refrigerant from the condenser to the compressor.

BRIEF DESCRIPTION OF THE DRAWINGS

The above mentioned and other features and objects of this invention, and the manner of obtaining them, will become more apparent and the invention itself will be better understood by reference to the following description of an embodiment of the invention taken in conjunction with the accompanying drawings, wherein.

DETAILED DESCRIPTION

Figure 1:
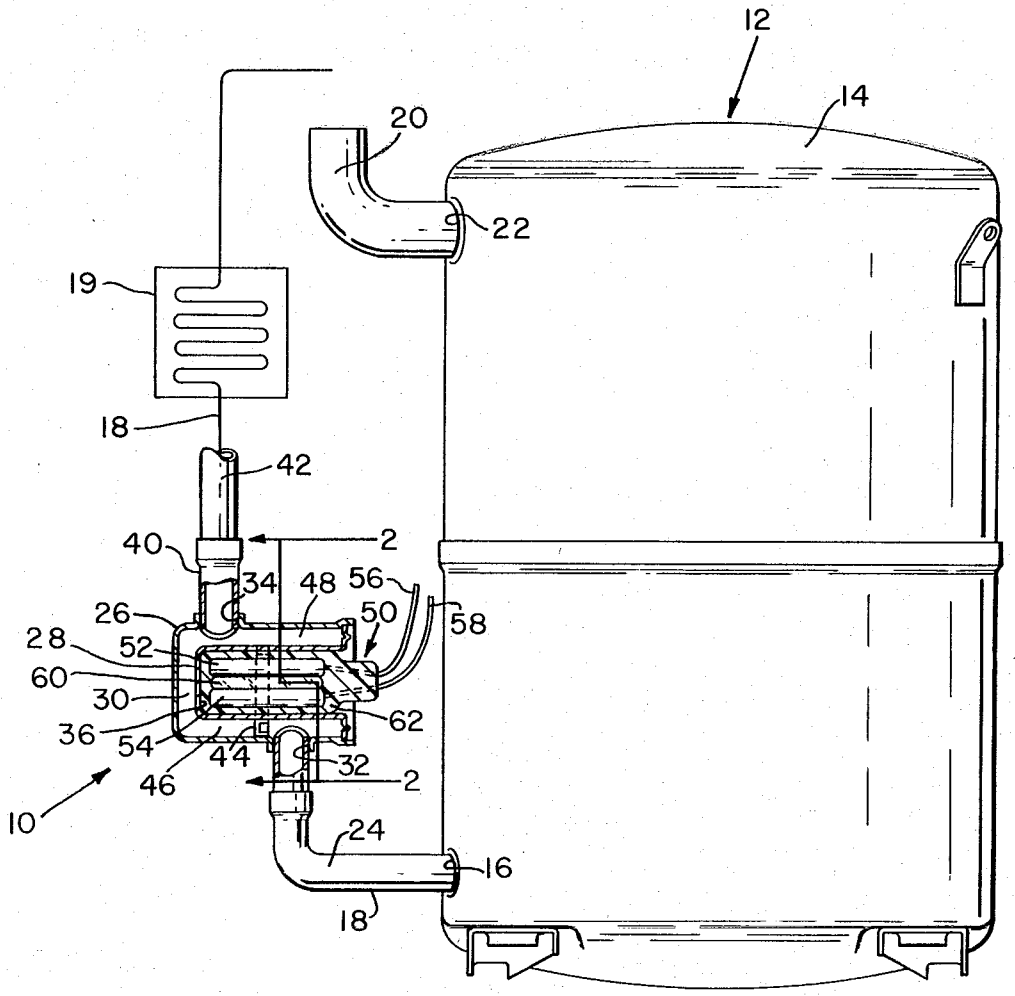
FIG. 1 is a broken-away part sectional view of a preferred embodiment of the present invention incorporated in the discharge line of a hermetic motor compressor.
Figure 2:
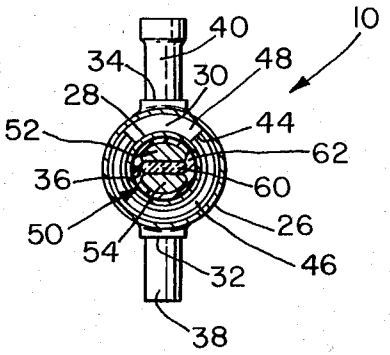
FIG. 2 is a sectional view of FIG. 1 taken along line 2—2 of FIG. 1 and viewed in the direction of the arrows.

Referring to FIGS. 1 and 2, thermal block 10 of the present invention is illustrated incorporated in compressor 12. Compressor 12 includes housing 14 having discharge outlet 16 and discharge line 18 connected to discharge outlet 16 and leading to and connected to a condenser 19. Compressor 12 further includes suction line 20 connected to suction inlet 22 and leading to and connected to an evaporator (not shown). The problem overcome by thermal block 10 is the migration of liquid refrigerant from condenser 19 through discharge line 18 and into housing 14 of compressor 12. This migration occurs during refrigeration system shutdown or during the normal off-cycle caused by thermostat operation. During the shutdown period, the condenser 19 ambient temperature may rise above the compressor 12 ambient temperature, thereby causing gaseous refrigerant at condenser 19 to recondense and migrate towards a colder area, which is the compressor 12 in a refrigeration system. This problem is further compounded if a liquid head exists, i.e., condenser 19 is elevated higher than compressor 12, or if the discharge line 18 passes through the cool oil in the compressor sump and then passes upwardly into the discharge muffler thereof. In the former case, liquid refrigerant is assisted in its migration by gravitational effects to compressor 12, and in the latter case the cool sump oil cools the discharge line, thereby increasing the rate of migration of liquid refrigerant. Once liquid refrigerant enters compressor 12, it can further migrate to the cylinder head in compressor 12 and cause slugging during compressor start-up, which may eventually cause the failure of gaskets, bearing misalignment, ruptured mufflers and the like.

As illustrated in FIG. 1, thermal block 10 is coupled in discharge line 18 adjacent discharge outlet 16 of compressor 12, and one of the purposes for this is that the heat supplied by thermal block 10 during its operation will transfer through section 24 of discharge line 18 and to housing 14, thereby decreasing the temperature differential between condenser 19 and compressor 12.

Thermal block 10 comprises a generally cup-shaped outer shell 26 and a generally cup-shaped inner shell 28 forming therebetween a hermetically closed chamber 30. Outer shell 26 has an inlet 32 and an outlet 34, and because of its cup-shape, defines heater well 36. Hermetically sealed in inlet 32 is throat 38 hermetically connected to section 24 of discharge line 18, and hermetically sealed in outlet 34 is throat 40 hermetically connected to section 42 of discharge line 18. To maintain the hermetic nature of compressor 12 and the refrigeration system in which it is installed, all connections of thermal block 10 are hermetically sealed, as is inner shell 28 to outer shell 26.

A baffle 44 is disposed in annular chamber 30 to divide chamber 30 into collecting area 46 and a second area 48. Baffle 44 only partially separates chamber 30 into areas 46, 48 as illustrated in FIG. 2 so that areas 46, 48 communicate with each other.

An electrical heating element 50 is disposed in heater well 36 and is in thermal conductive contact with the outer surface of inner shell 28. In the disclosed embodiment, heating element 50 comprises two heat sinks 52, 54, which in this embodiment are made of aluminum, and which have electrically connected thereto two wires 56, 58 for providing a source of electrical current. Heat sinks 52, 54 are spaced apart and have bonded therebetween a positive temperature coefficient (PTC) material 60 to complete the electrical circuit defined by wires 56, 58, and heat sinks 52, 54. PTC material 60 is a resistor element which has an increasing value of resistance as its temperature increases. Alternatively, other types of heating elements could be used. An electrically insulating casing 62 encapsulates heat sinks 52, 54, PTC material 60, and portions of wires 56, 58, thereby electrically insulating these elements and providing a heat transfer medium between the elements and inner shell 28. Casing 62 is preferably made of a silicone rubber material. However, casing 62 may be a solid material, such as a ceramic material, and a heat transfer agent is then disposed between the ceramic casing and inner shell 28 to ensure good thermal conductive characteristics.

In operation, electrical current is applied through wires 56, 58 to thermal block 10. During an off-duty cycle caused by normal thermostat (not shown) operation, the condenser ambient temperature may tend to rise and the compressor temperature tends to decrease due to the cooler oil and suction refrigerant to thereby increase the temperature differential between condenser 19 and compressor 12. Further, the temperature differential is increased also during shutdown of compressor 12 if discharge line 18 passes through the cool oil in the sump (not shown) in compressor 12. The cool oil during the shutdown of compressor 12 will further cool discharge line 18, thereby serving to further increase the temperature differential. During this time, gaseous refrigerant in condenser 19 will condense and migrate from the relatively warmer condenser ambient temperature to the relatively cooler ambient temperature existing in compressor 12 and discharge line 18. Whether condenser 19 is elevated above compressor 12 or not, the liquid refrigerant will migrate through discharge line 18 and eventually into the cylinder housing of compressor 12. If this occurs, upon start-up of compressor 12, slugging will occur.

With thermal block 10 incorporated in discharge line 18 adjacent discharge outlet 16, the migrating liquid refrigerant will flow through discharge line 18 and begin to fill collecting area 46 of chamber 30. Baffle 44 serves two purposes in this instance, the first being to prevent direct flow of the migrating liquid refrigerant from outlet 34 to inlet 32 of thermal block 10, and the second being to allow the cool liquid refrigerant to fill collecting area 46, which substantially encircles heating element 50 as illustrated in FIG. 2. As collecting area 46 fills, the temperature of heating element 50 is lowered and its resistance decreases to thereby cause PTC material 60 to become more electrically conductive, thereby increasing the current flow through PTC material 60. Electrical current passing through wires 56, 58, heat sinks 52, 54 and PTC material 60 causes PTC material 60 and heat sinks 52, 54 to rise in temperature and conduct the heat generated thereby through casing 62 to inner shell 28. The heat is then further transferred from inner shell 28 to outer shell 26, and the liquid refrigerant in collecting area 46 is then evaporated and returned through outlet 34 and discharge line 18 to condenser 19. The heat generated by heating element 50 prevents further recondensing of refrigerant in discharge line 18 between outlet 34 of thermal block 10 and condenser 19.

An advantage to the use of a PTC material 60 which is self-regulating is that it is becomes electrically less conductive with increasing temperature thereby reducing required wattage in operation. In other words, during operation of compressor 12, minimal current is applied to heating element 50, and the current increases only as the temperature of PTC material 60 falls below the predetermined temperature.

If a resistance heater (not shown) or some other type of solid state heater is utilized, it may be controlled by a separate thermostat that is responsive to a temperature differential between the condenser and compressor, to the temperature within the collecting chamber of the thermal block, or to the temperature at some other point in the system.

Figure 3:
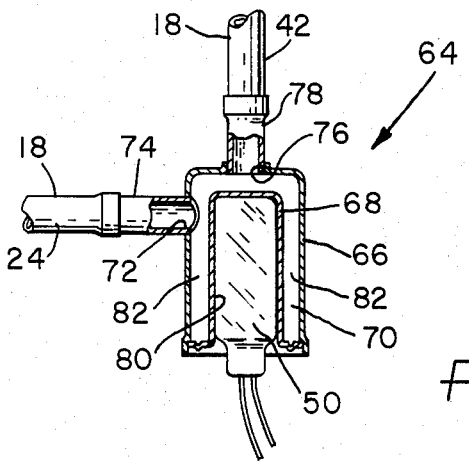
FIG. 3 is a broken-away part sectional view of an alternate embodiment of the thermal block forming a part of the present invention.

Referring now to FIG. 3, an alternate embodiment of the present invention is illustrated as thermal block 64 comprising an outer shell 66 and an inner shell 68 forming therebetween a hermetically sealed chamber 70. Chamber 70 has an inlet 72 with throat 74 hermetically sealed therein, throat 74 being hermetically coupled to section 24 of discharge line 18, and outlet 76 with throat 78 hermetically sealed therein, throat 78 being hermetically coupled to section 42 of discharge line 18. Thermal block 64 is cup-shaped, thereby defining heater well 80 for receiving heating element 50 therein. With thermal block 64 oriented with the opening of heater well 80 facing generally downwardly, collecting area 82 is defined in chamber 70 as that annular portion below inlet 72.

During an off-cycle operation of the refrigeration system, liquid refrigerant will migrate as described above through discharge line 18 and section 42 and will begin to fill collecting area 82. Heating element 50 then supplies heat to inner shell 68. The heat is then further transferred from inner shell 68 to outer shell 66 to evaporate the liquid refrigerant therein, which will then pass upwardly through discharge line 18 to the condenser. The supply of heat will further prevent subsequent accumulation of liquid refrigerant in thermal block 64.

Figure 4:
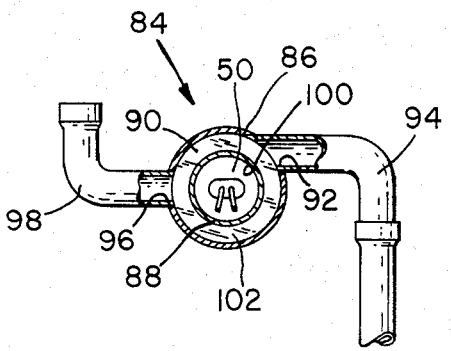
FIG. 4 is a broken-away part sectional view of another embodiment of the thermal block forming a part of the present invention.

Another embodiment of the present invention is illustrated in FIG. 4 as thermal block 84, which has its longitudinal axis generally horizontally disposed, comprising outer shell 86 and inner shell 88 defining therebetween hermetically sealed chamber 90. Chamber 90 has inlet 92 with throat 94 hermetically sealed therein and outlet 96 with throat 98 hermetically sealed therein. Heating element 50 is removably received in heater well 100, and a collecting area 102 is defined in chamber 90 as that part-cylindrical volume below outlet 96.

Figure 5:
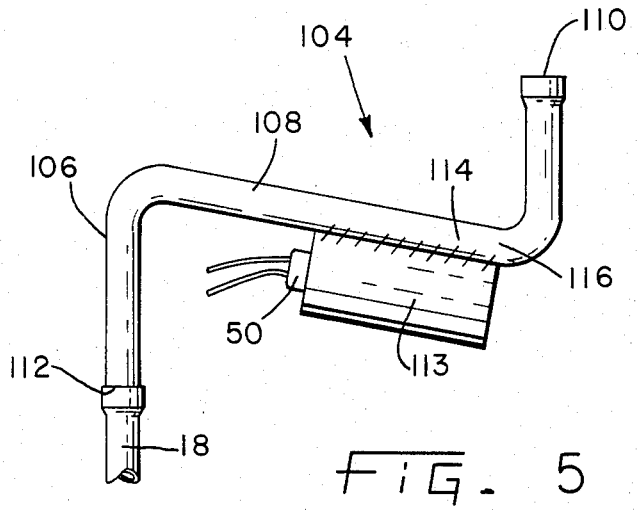
FIG. 5 is a side elevational view of still another embodiment of the thermal block forming a part of the present invention.

Still another embodiment of the present invention is illustrated in FIG. 5 as thermal block 104. Thermal block 104 comprises a generally Z-shaped tube 106 having an inclined section 108 with outlet 110 and inlet 112 hermetically coupled to discharge line 18. Heating element 50 is encased in well 113 which is attached, as by welding or brazing, to the undersurface of the lower elevated portion 114 of inclined section 108. A collecting area 116 is defined in the hollow area within lower elevated portion 114.

Upon compressor 12 shutting down during thermostat operation, liquid refrigerant will migrate through outlet 110 and collect in collecting area 116, thereby lowering the temperature of heating element 50 below the predetermined temperature. Heating element 50 will then supply heat to inclined section 108 to evaporate the collected liquid refrigerant and to prevent further accumulation thereof.

While this invention has been described as having preferred embodiments, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A refrigeration system, comprising:

a compressor having means for pumping pressurized refrigerant out a discharge outlet thereof, a discharge line connected to said discharge outlet of said compressor for delivering pressurized refrigerant from said compressor, and a thermal blocking means arranged in thermal contact with said discharge line for preventing migration of liquid refrigerant from said condenser to said compressor, said blocking means being operative when said compressor is inactive and comprising heating means to heat a portion of said discharge line, said heating means including means for decreasing the supply of heat to said discharge line as the temperature of said thermal blocking means increases.

2. The system of claim 1 wherein said thermal blocking means is adjacent to said discharge outlet of said compressor.

3. The system of claim 2 wherein said thermal blocking means is an electrical resistance-type heater.

4. The system of claim 2 wherein said thermal blocking means is an electrical solid-state heater device.

5. The system of claim 4 wherein said solid-state device includes a positive temperature coefficient material, the resistivity of said positive temperature coefficient material increasing with an increase of temperature and decreasing with a decrease in temperature, whereby refrigerant returning back through said discharge line lowers the temperature to thereby lower the resistivity of said positive temperature coefficient material, thereby increasing the current of electricity therethrough to supply heat to said portion of said discharge line, the resistivity of said positive temperature coefficient material increasing as the temperature rises after evaporation of refrigerant to thereby decrease the flow of electrical current, thereby decreasing the supply of heat.

6. The system of claim 5 wherein said solid-state device includes a heat sink to increase the conductance of heat.

7. The system of claim 1 wherein said thermal blocking means is an electrical solid-state device.

8. The system of claim 7 wherein said solid-state device includes a heat sink electrically connected to a positive temperature coefficient material, the resistivity of said positive temperature coefficient material increasing with increasing temperature and decreasing with decreasing tempertature, whereby upon decreasing temperature said positive temperature coefficient material resistivity decreases to increase the flow of electricity through said positive temperature coefficient material, thereby suppling heat to said discharge line.

9. The system of claim 1 wherein said thermal blocking means includes a housing having an outer wall and an inner wall forming therebetween a hermetically sealed chamber and being connected to said discharge line, said chamber communicating with said discharge line, said inner wall forming a well therein, said chamber being adapted to collect and contain liquid refrigerant migrating back through said discharge line, said heating means comprising an electrical heating device being received in said well and in thermally conductive abutment against the outer surface of said inner wall, said electrical heating device supplying heat to said housing to evaporate collected refrigerant therein and to prevent further accumulation of refrigerant therein.

10. The system of claim 9 wherein said electrical heating device is a solid-state device including a positive temperature coefficient material, the resistivity of said material increasing with an increase of temperature and decreasing with a decrease in temperature, whereby upon a decrease in temperature caused by the collection of refrigerant in said chamber, the resistivity of said material is decreased, thereby increasing the electrical current flow therethrough to supply heat to said discharge line, the resistivity of said material increasing as the temperature rises after evaporation of refrigerant in said chamber to thereby decrease the flow of electric current, thereby decreasing the supply of heat.

11. The system of claim 9 further including a baffle disposed in said chamber to partially divide said chamber, thereby preventing migrating refrigerant from passing directly through said chamber to said compressor.

12. A refrigeration system, comprising:

a condenser, a compressor including a discharge outlet for delivering gaseous refrigerant therefrom, a discharge line connected to said discharge outlet and said condenser, and a heating means in close proximity to said discharge line for supplying heat to said discharge line for thermally blocking and preventing refrigerant from returning back through said discharge line to said compressor, said heating means being responsive to the migration of liquid refrigerant from said condenser to said compressor for increasing the supply of heat to said discharge line, said heating means including means for decreasing the supply of heat to said discharge line as the temperature of said discharge line increases.

13. The system of claim 12 wherein said heating means is an electrical solid-state device.

14. The system of claim 13 wherein said solid-state device includes a positive temperature coefficient material, the resistivity of said material increasing with an increase of temperature and decreasing with a decrease in temperature, whereby refrigerant returning back through said discharge line lowers the temperature to thereby lower the resistivity of said material, thereby increasing the current of electricity therethrough to supply heat to said portion of said discharge line, the resistivity of said material increasing as the temperature rises after evaporation of refrigerant to thereby decrease the flow of electrical current, thereby, decreasing the supply of heat.

15. The system of claim 14 wherein said solid-state device is in thermally conductive contact with said discharge line.

16. The system of claim 15 wherein said solid-state device is adjacent to said discharge outlet.

17. In combination with a hermetic motor compressor having a discharge outlet and a discharge line connected to said outlet and to a condenser for delivering a refrigerant from said compressor to said condenser, a discharge line thermal block for preventing the flow of liquid refrigerant from said condenser to said compressor, comprising:

a housing having a chamber therein and being connected within said discharge line, a portion of said discharge line leading to said housing being an inlet thereof and communicating with said chamber and a portion of said discharge line leading away from said housing being an outlet thereof and communicating with said chamber, said chamber being adapted to collect and contain liquid refrigerant migrating from said condenser through said discharge line during off-cycle operation of said compressor, and an electric heating means in thermal contact with said chamber to supply heat to refrigerant in said chamber to evaporate liquid refrigerant in said chamber and to prevent migration of liquid refrigerant to said compressor through said discharge line, said heating means responsive to pooling of refrigerant migrating from said condensor to increase heat supplied to said discharge line and including means for reducing the flow of current to said heating means as the temperature of said chamber increases.

18. The combination of claim 17 further including a baffle disposed in said chamber between said chamber inlet and said chamber outlet to partially divide said chamber, thereby preventing migrating liquid refrigerant from passing directly through said chamber to said compressor.

19. The combination of claim 17 wherein said electric heating means is a positive temperature coefficient resistance element.

20. The combination of claim 17 wherein said heating means comprises a positive temperature coefficient material disposed between and attached to heat sinks, said positive temperature coefficient material being more electrically conductive with increased temperature and electrically less conductive with decreased temperature.

21. The combination of claim 17 wherein said housing is connected to said discharge line adjacent to said discharge outlet of said compressor.

* * * * *